US009889483B1

(12) United States Patent
Allen

(10) Patent No.: US 9,889,483 B1
(45) Date of Patent: Feb. 13, 2018

(54) PAINTLESS VEHICLE DENT REPAIR TOOL

(71) Applicant: William Allen, Centennial, CO (US)

(72) Inventor: William Allen, Centennial, CO (US)

( * ) Notice: Subject to any disclaimer, the term of this patent is extended or adjusted under 35 U.S.C. 154(b) by 0 days.

(21) Appl. No.: 15/642,598

(22) Filed: Jul. 6, 2017

Related U.S. Application Data

(60) Provisional application No. 62/359,923, filed on Jul. 8, 2016.

(51) Int. Cl.

| | |
|---|---|
| ***B21D 37/00*** | (2006.01) |
| ***B21D 1/08*** | (2006.01) |
| ***B25D 3/00*** | (2006.01) |
| ***B21D 1/06*** | (2006.01) |

(52) U.S. Cl.
CPC ..... *B21D 1/08* (2013.01); *B21D 1/06* (2013.01); *B25D 3/00* (2013.01)

(58) Field of Classification Search
CPC ..... B25D 3/00; B21D 1/06; B21D 1/08
USPC ..... 72/479
See application file for complete search history.

(56) References Cited

U.S. PATENT DOCUMENTS

| | | | | |
|---|---|---|---|---|
| 6,722,179 B1 * | 4/2004 | Ventura | ..... | B21D 1/06 72/454 |
| 2009/0056407 A1 * | 3/2009 | Greene | ..... | B25D 3/00 72/481.1 |

* cited by examiner

*Primary Examiner* — David B Jones
(74) *Attorney, Agent, or Firm* — Edwin H. Crabtree; Ramon L. Pizarro

(57) ABSTRACT

A paintless vehicle dent repair tool for repairing dents, such as dents caused by hail damage, in the top of a vehicle. The repair tool includes an elongated, annular shaped, tool body. The tool body includes a concave, wedge-shaped end portion for engaging and removing glue from a dent and a hollow opposite end portion. The hollow opposite end portion is used for holding a removable spray bottle of alcohol. A spray of alcohol is used for helping release dried glue from a raised dent on a vehicle.

15 Claims, 2 Drawing Sheets

PAINTLESS VEHICLE DENT REPAIR TOOL

This non-provisional patent application claims the benefit of the subject matter and filing date of a provisional patent application, Ser. No. 62/359,923, filed on Jul. 8, 2016, by the subject inventor and having a title of "Paintless Vehicle Dent Repair Tool".

BACKGROUND OF THE INVENTION

(a) Field of the Invention

This invention relates to a dent repair tool, and more particularly, but not by way of limitation, to a paintless vehicle dent repair tool used for removing dents on a vehicle do to hail damages and similar damage.

(b) Discussion of Prior Art

Heretofore, there have been a number of different types of dent repair tools used for removing dents on a vehicle. None of these repair tools include in combination, a tool body having a concave, wedge-shaped end portion and a hollow, opposite end portion for receiving a spray bottle filled with alcohol.

SUMMARY OF THE INVENTION

In view of the foregoing, it is a primary objective of the subject invention to provide a combination repair dent tool for quick repair of vehicle dents, typically caused by hail and without vehicle paint removal.

Another object the invention is the dent repair tool saves time by eliminating the need of a dent repair person having to use a separate wedge tool of engaging the glue and the going to find a separate spray bottle with alcohol for spraying on the dried glue.

Still another object of the invention is the tool can include an embedded magnet in the tool body. The magnet is used for holding the tool in place on a metal surface and when the tool is not in use.

The paintless vehicle dent repair tool includes an elongated, annular shaped, tool body. The tool body includes a concave, wedge-shaped end portion for engaging and removing glue from a dent and a hollow opposite end portion. The hollow opposite end portion is used for holding a removable spray bottle of alcohol. A spray of alcohol is used for helping release dried glue from a raised dent on a vehicle.

These and other objects of the present invention will become apparent to those familiar with different types of dent repair tools when reviewing the following detailed description, showing novel construction, combination, and elements as herein described, and more particularly defined by the claims, it being understood that changes in the embodiments are meant to be included as coming within the scope of the claims, except insofar as they may be precluded by the prior art.

BRIEF DESCRIPTION OF THE DRAWINGS

The accompanying drawings illustrate complete preferred embodiments in the present invention devised for the practical application of the subject dent repair tool, and in which:

In FIG. 3, a glue gun 34 is shown applying hot glue 36 to the bottom of the base 28. In FIG. 4, the hot glue 36 is shown being lowered into the dent 22 using the glue tab 26. In FIG. 5, the hot glue 36 is shown drying inside the dent 22. In FIG. 6, the glue tab 26 and dried glue 36 is shown be raised, as indicated by arrows 38, moving the dent 22 upwardly into a raised convex portion on the vehicle roof 24, thus removing the dent.

In FIGS. 7 and 8, the subject dent repair tool 10 is shown in use. In FIG. 7, the spray bottle 16 is shown spraying alcohol 18 around the dried glue 36 and the raised dent 22. In FIG. 8, the dent repair tool 10 has been turned around and the wedge-shaped end portion 36 is shown inserted between the glue 36 and the raised dent 22. At this time, the glue 36 and the glue tab 26 are release from the vehicle roof 24 and the raised dent is then polished completing the vehicle roof repair.

Figure 1:
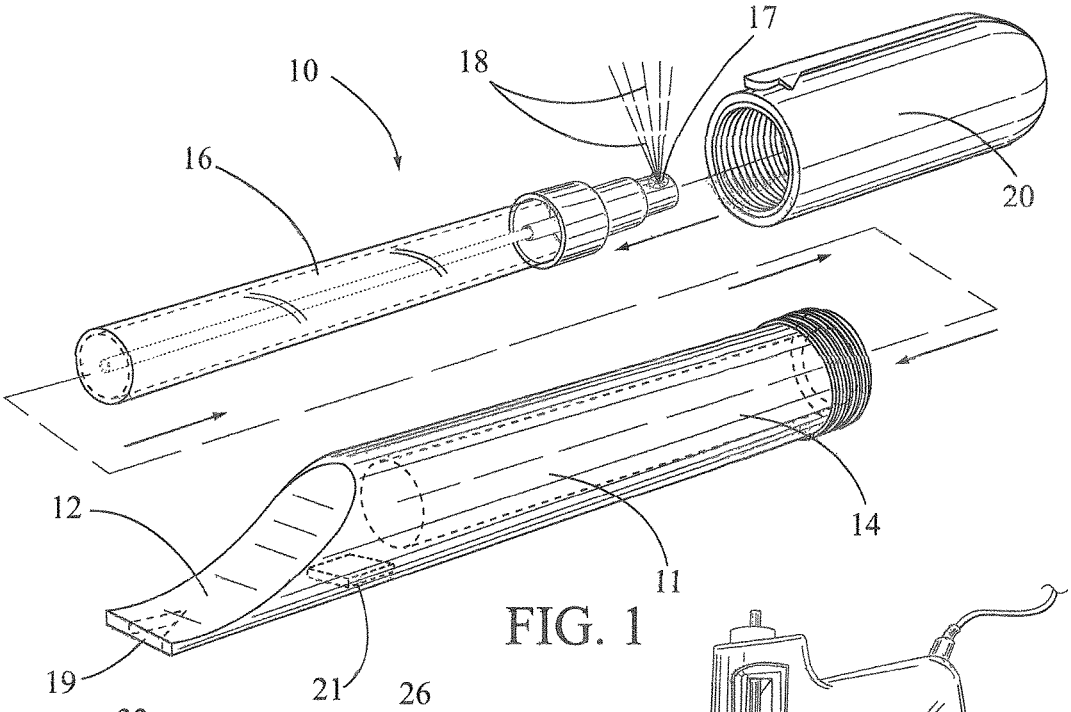
FIG. 1 is a perspective view of the dent repair tool with a tool body shown receiving a spray bottle with alcohol in a hollow, opposite end portion.
Figure 2:
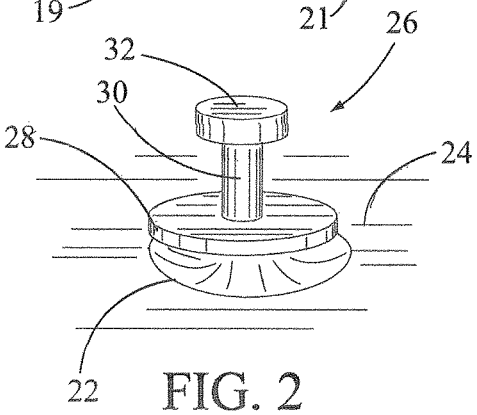
FIGS. 2-8 illustrate various steps required to repair a dent in a top of a vehicle and using the subject tool to remove dried glue from a raised dent on the vehicle.
Figure 3:
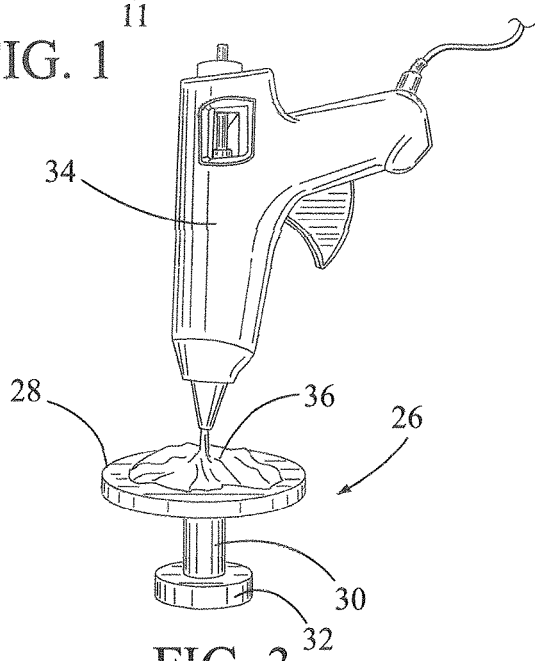
Figure 4:
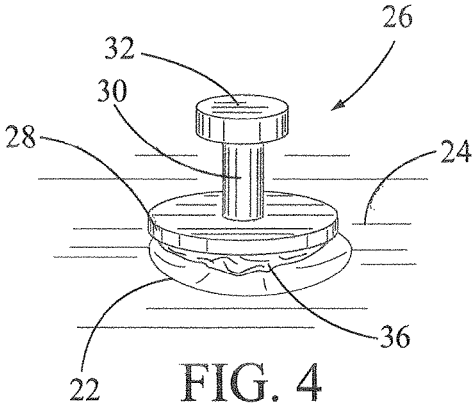
Figure 5:
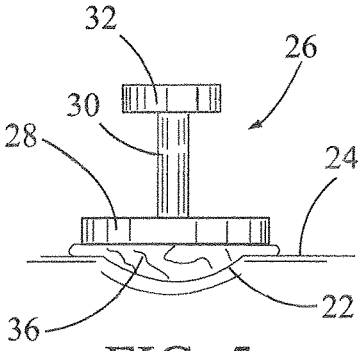
Figure 6:
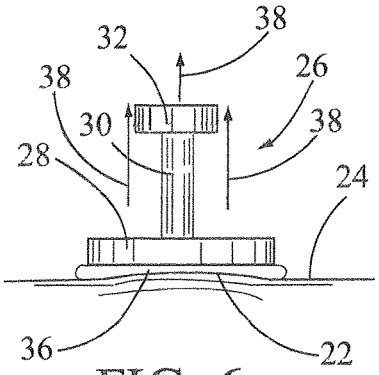
Figure 7:
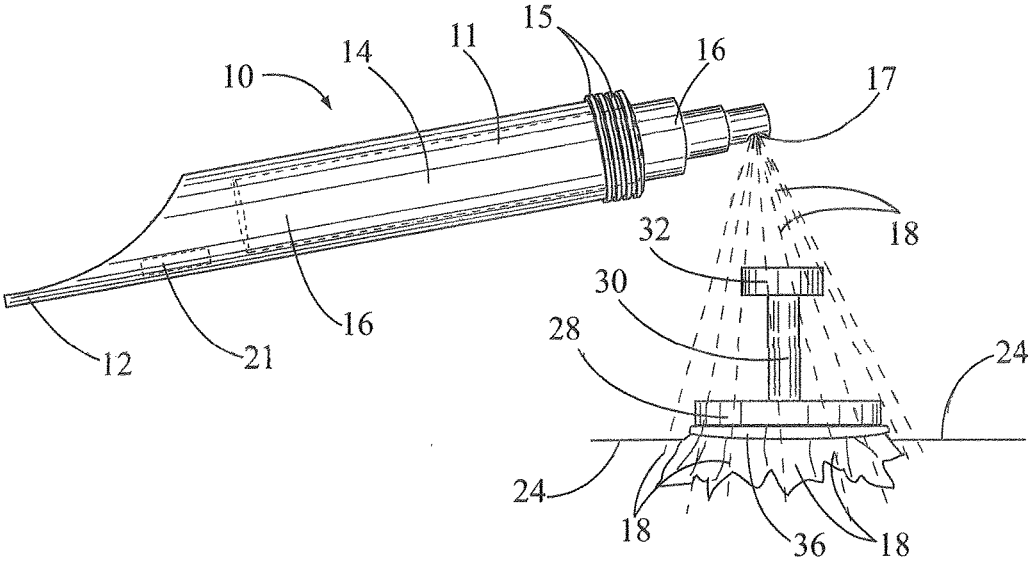
Figure 8:
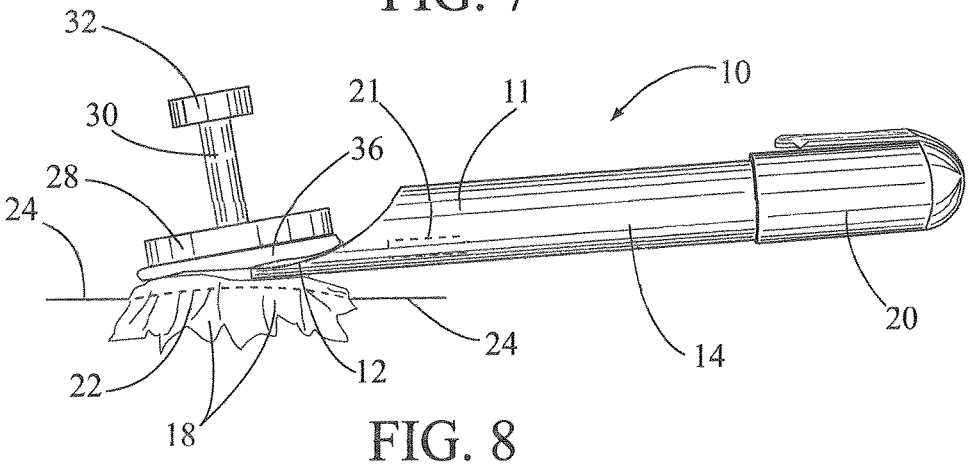

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The invention claimed is:

1. A paintless vehicle dent repair tool, the repair tool comprising:

an elongated, tubular-shaped, tool body;

a wedge-shaped end portion in one end of the tool body and adapted for engaging and removing glue from a dent;

a hollow opposite end portion in an opposite end of the tool body; and a removable spray bottle of alcohol slidably received inside the hollow opposite end portion of the tool body, wherein a spray of alcohol is used from the spray bottle for helping release dried glue from a raised dent on a vehicle.

2. The repair tool as described in claim 1 wherein the wedge-shaped end portion includes a notch therein for helping release the dried glue from the raised dent.

3. The repair tool as described in claim 1 further including magnet attached to the tool body, the magnet used for holding the repair tool on the vehicle when the tool is not in use.

4. The repair tool as described in claim 1 further including an end cap for attaching to an end of the opposite end portion, the end cap used for holding the repair tool in a pocket of a dent repair person.

5. The repair tool as described in claim 1 wherein the tool body has a length in a range of 6 to 10 inches and a diameter of ¾ to 1¼ inches.

6. A paintless vehicle dent repair tool, the repair tool used for repairing a dent on a vehicle, the repair tool comprising:

an elongated, tubular-shaped, tool body;

a wedge-shaped, concave end portion in one end of the tool body, the end portion adapted for engaging and removing glue from a dent;

a hollow opposite end portion in an opposite end of the tool body; and a removable spray bottle with spray nozzle, the spray bottle filled with alcohol, the spray bottle slidably received inside the hollow opposite end portion of the tool body, wherein a spray of alcohol is used from the spray bottle for helping release dried glue from a raised dent on the vehicle.

7. The repair tool as described in claim 6 wherein the wedge-shaped end portion includes a notch therein for helping release the dried glue from the raised dent.

8. The repair tool as described in claim 6 further including magnet embedded inside the tool body, the magnet is used for holding the repair tool on the vehicle when the tool is not in use.

9. The repair tool as described in claim 6 further including an end cap for releasable attachment to an end of the opposite end portion, the end cap used for holding the repair tool in a pocket of a dent repair person.

10. The repair tool as described in claim 6 wherein the tool body having a length a in a range of 6 to 10 inches and a diameter in a range of ¾ to 1¼ inches.

11. A paintless vehicle dent repair tool, the repair tool used for repairing a dent on a vehicle, the repair tool comprising:

an elongated, tubular-shaped, tool body;

a wedge-shaped, concave end portion in one end of the tool body, the end portion adapted for engaging and removing glue from a dent;

a hollow opposite end portion in an opposite end of the tool body, the hollow opposite end portion adapted for receiving alcohol therein, an end of the opposite end portion having threads thereon; and a spray nozzle, the spray nozzle attached to the treads on the end of the opposite end portion, the spray nozzle used for spraying alcohol on dried glue for helping release the dried glue from a raised dent on the vehicle.

12. The repair tool as described in claim 11 wherein the wedge-shaped end portion includes a notch therein for helping release the dried glue from the raised dent.

13. The repair tool as described in claim 11 further including magnet embedded inside the tool body, the magnet used for holding the repair tool on the vehicle when the tool is not in use.

14. The repair tool as described in claim 11 further including an end cap for releasable attachment to an end of the opposite end portion, the end cap used for holding the repair tool in a pocket of a dent repair person.

15. The repair tool as described in claim 11 wherein the tool body has a length in range of 6 to 10 inches and a diameter of ¾ to 1¼ inches.

* * * * *